US006612469B2

(12) United States Patent
Lopez Pardo

(10) Patent No.: US 6,612,469 B2
(45) Date of Patent: Sep. 2, 2003

(54) DROPPING BOTTLE FOR LIQUIDS, PARTICULARLY FOR PHARMACEUTICAL PRODUCTS

(75) Inventor: Hector Lopez Pardo, Hollywood, FL (US)

(73) Assignee: World Pharmaceutical S.A., Panama (PN)

( * ) Notice: Subject to any disclaimer, the term of this patent is extended or adjusted under 35 U.S.C. 154(b) by 0 days.

(21) Appl. No.: 10/025,038

(22) Filed: Dec. 19, 2001

(65) Prior Publication Data

US 2002/0079338 A1 Jun. 27, 2002

(30) Foreign Application Priority Data

Dec. 22, 2000 (IT) ..... MO2000A0285

(51) Int. Cl.[7] ..... B65D 47/18
(52) U.S. Cl. ..... 222/214; 222/420

(58) Field of Search ..... 222/214, 420

(56) References Cited

U.S. PATENT DOCUMENTS 3,552,605 A 1/1971 Hein
5,158,192 A 10/1992 Lataix
5,487,495 A 1/1996 Derksen

*Primary Examiner*—Philippe Derakshani
(74) *Attorney, Agent, or Firm*—Daniel O'Byrne

(57) ABSTRACT

A dropping bottle for liquids, particularly pharmaceutical products, comprising an elastically deformable drop dispenser pipette, which is provided, at its top, with a dispensing hole and is coupled hermetically, in a downward region, to the neck of the bottle, and a cap for the upper closure of the pipette, at least one pair of mutually opposite semirigid wings, which wrap coaxially around the pipette and are adapted to compress it, by radial action of two fingers, in order to dispense constant doses of the contained liquid, the wings being shorter than, or as long as, the pipette.

20 Claims, 3 Drawing Sheets

DROPPING BOTTLE FOR LIQUIDS, PARTICULARLY FOR PHARMACEUTICAL PRODUCTS

BACKGROUND OF THE INVENTION

The present invention relates to a dropping bottle for liquids, particularly for pharmaceutical products.

Containers for liquid products, pharmaceutical products, cosmetic products or the like are known which have a dispenser pipette, made of a material of the elastic type and adapted to dispense calibrated drops of liquid by squeezing.

These containers are not devoid of drawbacks, including the fact that they have no device that allows the pipette to dispense a preset quantity of drops.

Accordingly, the user has to count the drops dispensed during the intermittent squeezing of the elastic pipette, which he performs with his fingers, or dispense a dose other than the optimum one, with the risk of having to throw away the amount squeezed in excess and, consequently, wasting product.

SUMMARY OF THE INVENTION

The aim of the present invention is to eliminate the above noted drawbacks of known types of dispensing containers by devising a dropping bottle for liquids, particularly pharmaceutical products, that allows to dispense a constant quantity of drops and to dose two or more different preset quantities of drops.

Within this aim, an object of the present invention is to achieve the above aim with a structure that is simple, relatively easy to provide in practice, safe in use, effective in operation, and relatively low in cost.

This aim and these and other objects that will become better apparent hereinafter are achieved by the present dropping bottle for liquids, particularly pharmaceutical products, which comprises an elastically deformable drop dispenser pipette, which is provided, at its top, with a dispensing hole and is coupled hermetically, in a downward region, to the neck of the bottle, and a cap for the upper closure of said pipette, characterized in that it comprises at least one pair of mutually opposite semirigid wings, which wrap coaxially around said pipette and are adapted to compress it, by radial action of two fingers, in order to dispense constant doses of the contained liquid, said wings being shorter than, or as long as, said pipette.

BRIEF DESCRIPTION OF THE DRAWINGS

Further characteristics and advantages of the present invention will become better apparent from the detailed description of a preferred but not exclusive embodiment of a dropping bottle for liquids, particularly pharmaceutical products, illustrated only by way of non-limitative example in the accompanying drawings, wherein.

DESCRIPTION OF THE PREFERRED EMBODIMENTS

Figure 1:
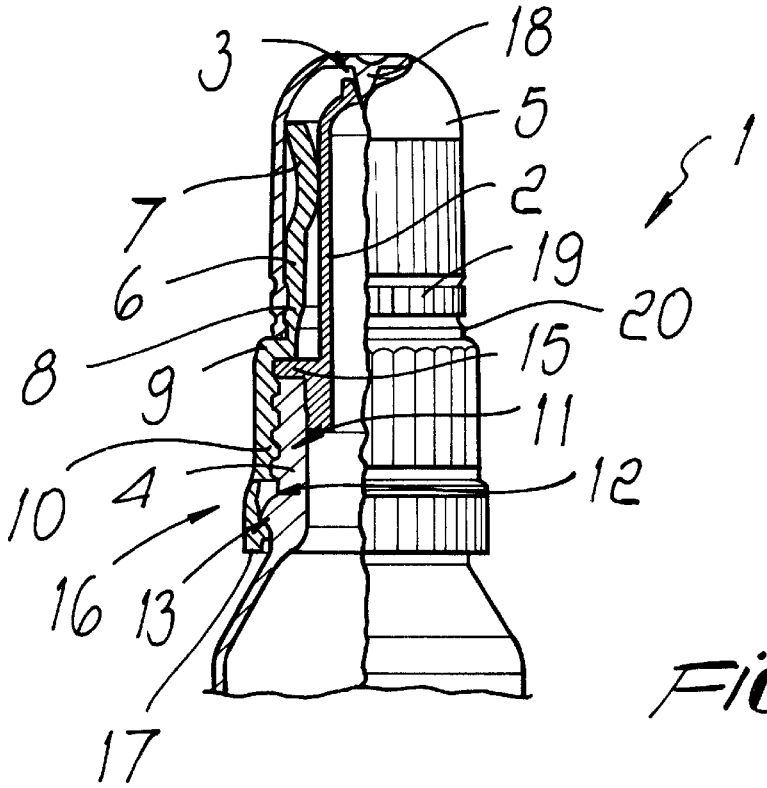
FIG. 1 is a partially sectional side view of the upper part of a dropping bottle for liquids, particularly pharmaceutical products, according to the invention.
Figure 2:
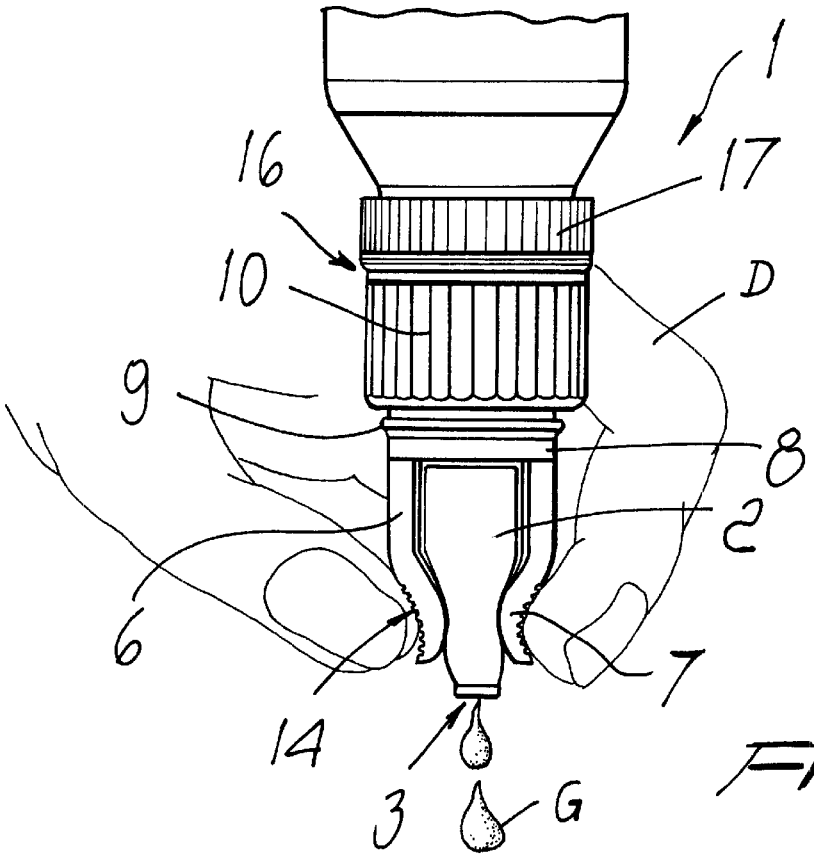
FIG. 2 is a side view of the upper portion of the bottle according to the invention, in the configuration for dispensing the drops.
Figure 3:
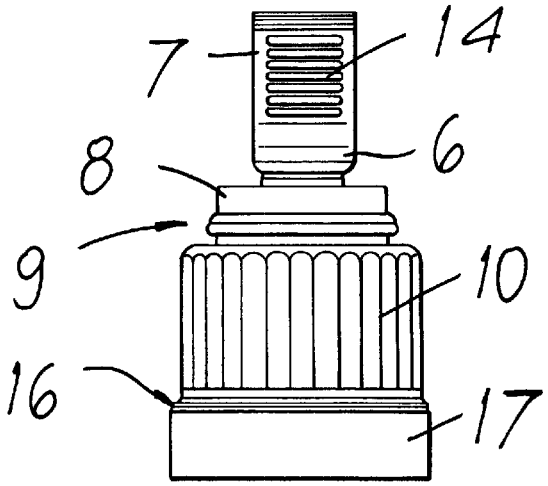
FIG. 3 is a front view of a pair of wings of the bottle according to the invention.
Figure 4:
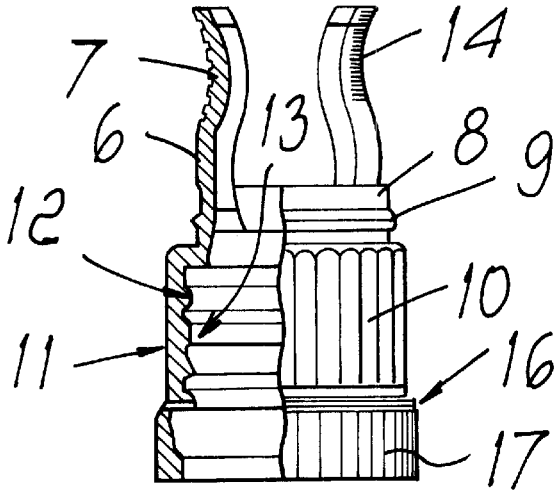
FIG. 4 is a partially sectional side view of the pair of wings of FIG. 3.
Figure 5:
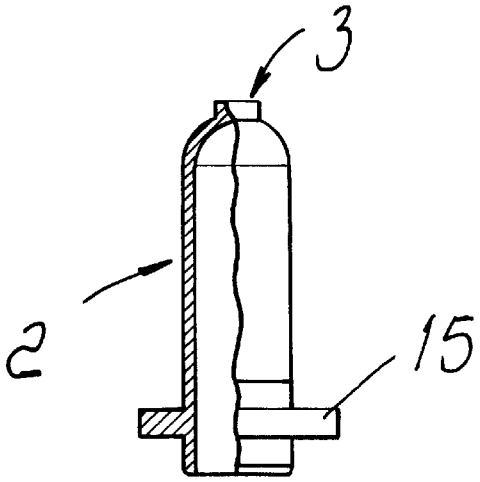
FIG. 5 is a partially sectional view of the pipette of the bottle according to the invention.

With reference to the figures, the reference numeral 1 generally designates a dropping bottle for liquids, particularly pharmaceutical products.

The bottle 1 comprises a drop dispenser pipette 2, made of a material of the elastically deformable type and provided, at the top, with a hole 3 for dispensing the contained liquid.

The pipette 2 is coupled hermetically, in a downward region, to the neck 4 of the bottle 1 and can be closed by an upper closure cap 5.

Two mutually opposite semirigid and flexible wings 6 coaxially surround the pipette 2 and are adapted to compress it, through a radial action of two fingers D of the user, in order to dispense drops G of constant doses of the liquid contained in the bottle 1, said wings 6 being as long as, or shorter than, said pipette.

The lower end of the wings 6 is rigidly coupled to the neck 4 of the bottle 1 and the upper end of said wings is free and provided with a contoured portion 7, which is adapted to partially or fully clamp the end part of the pipette 2 so as to squeeze fully or partially out of it, in calibrated drops G, the liquid contained in the volume enclosed in said part of the pipette.

The mutually opposite wings 6 are fixed in a downward region to a cylindrical ring 8, which is coaxial to the pipette 2 and rigidly coupled to an underlying flat ring 9, which is crossed by said pipette.

Advantageously, the flat ring 9 is extended outward and downward by an annular connector 10 provided with detachable coupling means 11 for coupling to the neck 4 of the bottle 1.

The coupling means 11 are constituted by a threaded portion 12, which can be screwed onto a corresponding threaded portion 13 of the upper rim of the neck 4, but alternative embodiments, such as interlocking coupling, push-fit coupling, or the like, are also possible.

The contoured portion 7 of the wings 6 is substantially concave, so as to allow better squeezing of the pipette 2, and is externally provided with a plurality of knurled portions 14 adapted to facilitate grip with one's fingers D.

The pipette 2 is provided in a downward region with an outer ring 15, which acts as a flange for coaxial retention and peripheral locking on the neck 4, against the top of which the ring 15 is kept pressed by the flat ring 9 superimposed thereon.

Figure 6:
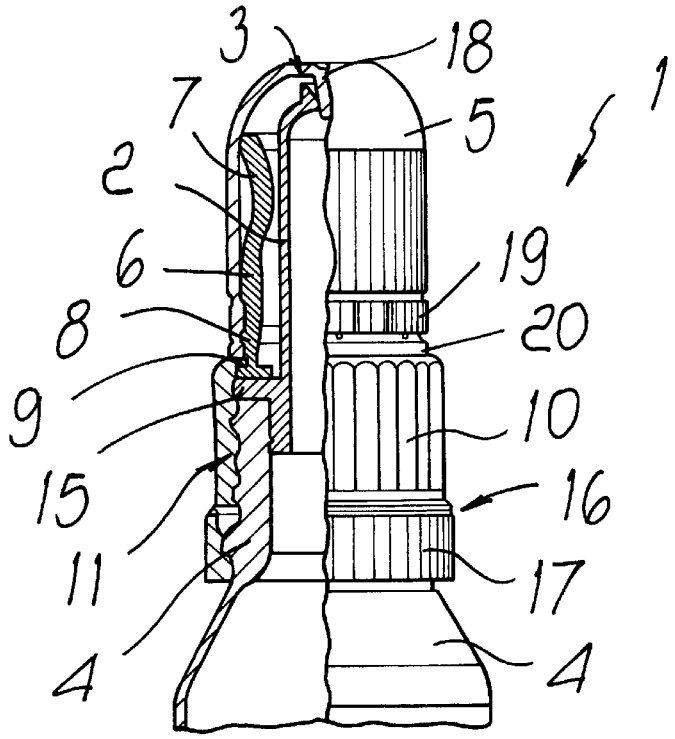
FIG. 6 is a partially sectional side view of the upper portion of an alternative embodiment of the bottle according to the invention.
Figure 7:
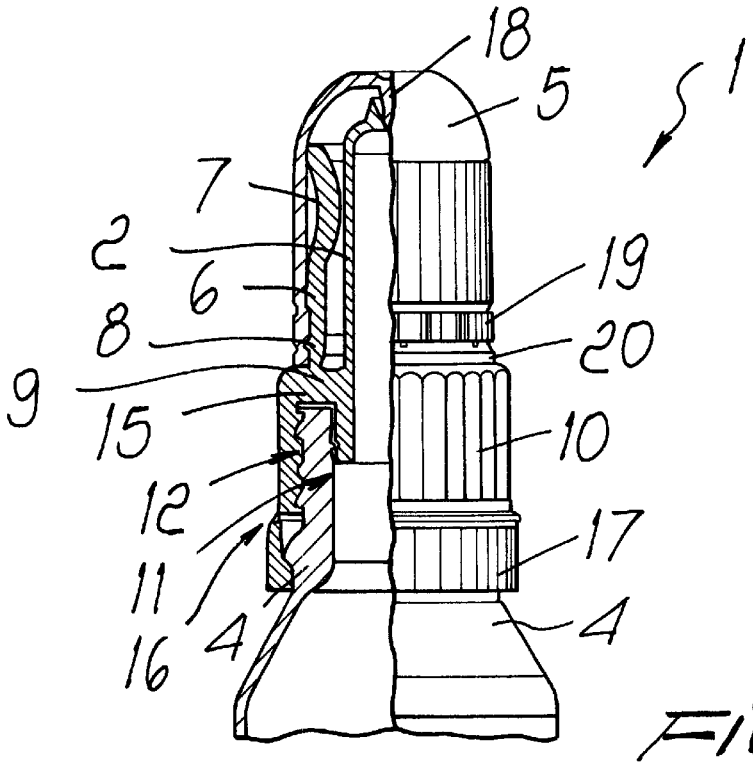
FIG. 7 is a partially sectional side view of the upper portion of a further alternative embodiment of the bottle according to the invention.

In the alternative embodiment of FIG. 6, the flat ring 9 and the underlying annular connector 10 are provided as two separate parts, while in the further embodiment of FIG. 7 they are provided as a single part monolithically with the pipette 2.

Conveniently, the annular connector 10 is coupled in a downward region, with interposed sealing means 16, to an underlying additional ring 17, which can be anchored to the lower portion of the neck 4 of the bottle 1.

The interposed sealing means 16 can be constituted by an annular connecting portion, which is continuous or constituted by a plurality of bridges distributed so as to be substantially equidistant and provided with a prefracture zone or line.

In another alternative embodiment, not shown, the bottle 1 can have a plurality of pairs of mutually opposite wings 6 having identical or different lengths and distributed so as to allow the user to act separately on each pair.

The closure cap 5 comprises, in an upward region, a plug element 18, which is directed downward and is adapted to block the dispensing hole 3 of the pipette 2.

The cap 5 is meant to close the pipette 2 and protect the wings 6; it is also provided with a tear-off tamper-evident or tamper-proof band 19 of the conventional type, and with an additional underlying ring 20 which can be separated for permanent anchoring to the neck 4 of the bottle 1.

The operation of the invention is as follows: after removing the tamperproof band 19, the user removes the closure cap 5, thus releasing the wings 6; after pointing the bottle 1 downward, he presses fully the pair of mutually opposite wings against the sides of the elastic pipette 2, squeezing out the intended corresponding dose.

In the case of a plurality of pairs of wings of identical length and having the same shape and dimensions in their contoured portion, it makes no difference whether one acts on one pair or the other.

In the case of a plurality of pairs of wings having different lengths, instead, by squeezing the pipette with the shortest wings the maximum dose is obtained, while by acting on the longest wings the minimum dose is obtained.

If the wings of the pairs of the same length have a different shape or size of their contoured portion, it is possible to obtain different dosages.

In practice it has been found that the described invention achieves the intended aim and objects, i.e., to avoid dangerous incorrect dosages of the liquid and possible waste, to ensure dosage precision and faster squeezing of the pipette, and to allow to obtain two or more constant dosages of different values.

It is in fact sufficient to replace, in a same bottle and with a same pipette, a pair of squeezing wings of a given length with a similar pair of wings having a different length.

The invention thus conceived is susceptible of numerous modifications and variations, all of which are within the scope of the appended claims.

All the details may further be replaced with other technically equivalent ones.

In practice, the materials used, as well as the shapes and the dimensions, may be any according to requirements without thereby abandoning the scope of the protection of the appended claims.

The disclosures in Italian Patent Application No. M02000A000285 from which this application claims priority are incorporated herein by reference.

What is claimed is:

1. A dropping bottle for liquids, comprising:

a neck;

an elastically deformable drop dispenser pipette extending along an axis thereof and being provided, at a top region, with a dispensing hole, said pipette being coupled hermetically, in a downward region, to said neck;

a cap for closing said pipette;

at least one pair of mutually opposite semirigid wings, which are arranged so as to wrap around said pipette coaxially thereto and to extend along said pipette for a distance at the most as long as an extension of the pipette along said axis;

a cylindrical ring that is coaxial to said pipette; and an underlying flat ring coupled to the neck of the bottle so as to be crossed by said pipette, said cylindrical ring being rigidly coupled to said flat ring;

wherein each one of said opposite wings is fixed in a downward region thereof to said cylindrical ring and has an upper free end provided with a contoured portion shaped so as to clamp said pipette proximate to said dispensing hole in combination with a corresponding contoured portion of an opposite wing of said at least one pair of wings, upon actuation through a two finger radial action for providing compression of said pipette such as to dispense constant doses of liquid contained in the bottle.

2. The bottle of claim 1, further comprising an annular connector extending outwardly and downwardly from said flat ring, and detachable coupling means provided at said annular connector for coupling to said neck of the bottle.

3. The bottle of claim 2, wherein said neck has a threaded portion, said detachable coupling means being constituted by a threaded portion that is screwable onto said threaded portion of said neck.

4. The bottle of claim 2, wherein said detachable coupling means are constituted by a coupling portion that is coupled by interlocking to an upper rim part of said neck.

5. The bottle of claim 1, wherein the contoured portion of each one of said wings is substantially concave.

6. The bottle of claim 5, wherein each one of said wings comprises externally, proximate to the contoured portion a plurality of knurled portions for finger grip.

7. The bottle of claim 1, wherein said pipette is provided, in a downward region, with an outer ring for coaxial retention and peripheral locking thereof on said neck.

8. The bottle of claim 7, wherein said flat ring is superimposed on said outer ring of the pipette to keep the outer ring pressed against said neck.

9. The bottle of claim 8, wherein said at least one pair of wings, said underlying flat ring and said annular connector monolithic with said pipette.

10. The bottle of claim 2, further comprising an additional ring underlying said annular connector, and sealing means, said annular connector being coupled in a downward region, with interposed said sealing means, to said underlying additional ring which is further anchored to a lower portion of the neck of the bottle.

11. The bottle of claim 10, wherein said sealing means is constituted by at least one portion of a circumference region provided with a prefracture zone.

12. The bottle of claim 10, wherein said sealing means are constituted by a plurality of bridges distributed so as to be substantially equidistant.

13. The bottle of claim 1, wherein said closure cap comprises, in an upward region, a plug element, which is directed downward so as to close the dispensing hole of the pipette.

14. A dropping bottle for liquids, comprising;

a neck;

an elastically deformable drop dispenser pipette extending along an axis thereof and being provided, at a top region, with a dispensing hole, said pipette being coupled hermetically, in a downward region, to said neck;

a cap for closing said pipette;

at least one pair of mutually opposite semirigid wings, which are arranged so as to wrap around said pipette coaxially thereto and to extend along said pipette for a distance at the most as long as an extension of the pipette along said axis;

a cylindrical ring that is coaxial to said pipette;

an underlying flat ring coupled to the neck of the bottle so as to be crossed by said pipette, said cylindrical ring being rigidly coupled to said flat ring;

an annular connector extending outwardly and downwardly from said flat ring; and detachable coupling means provided at said annular connector for coupling to said neck of the bottle, wherein each one of said opposite wings is fixed in a downward region thereof to said cylindrical ring and has an upper free end provided with a contoured portion shaped so as to clamp said pipette proximate to said dispensing hole in combination with a corresponding contoured portion of an opposite wing of said at least one pair of wings, upon actuation through a two finger radial action for providing compression of said pipette such as to dispense constant doses of liquid contained in the bottle.

15. A dropping bottle for liquids, comprising:

a neck;

an elastically deformable drop dispenser pipette extending along an axis thereof and being provided, at a top region, with a dispensing hole, said pipette being coupled hermetically, in a downward region, to said neck;

a cap for closing said pipette;

at least one pair of mutually opposite semirigid wings, which are arranged so as to wrap around said pipette coaxially thereto and to extend along said pipette for a distance at the most as long as an extension of the pipette along said axis;

a cylindrical ring that is coaxial to said pipette;

an underlying flat ring coupled to the neck of the bottle so as to be crossed by said pipette, said cylindrical ring being rigidly coupled to said flat ring;

wherein each one of said opposite wings is fixed in a downward region thereof to said cylindrical ring and has an upper free end provided with a contoured portion of concave shape for clamping said pipette proximate to said dispensing hole in combination with a corresponding contoured portion of concave shape of an opposite wing of said at least one pair of wings, upon actuation through a two finger radial action for providing compression of said pipette such as to dispense constant doses of liquid contained in the bottle.

16. The bottle of claim 15, wherein each one of said wings comprises externally, proximate to the contoured portion a plurality of knurled portions for finger grip.

17. The bottle claim 15, wherein said pipette is provided, in a downward region, with an outer ring for coaxial retention and peripheral locking thereof on said neck.

18. The bottle of claim 17, wherein said flat ring is superimposed on said outer ring of the pipette to keep the outer ring, pushed against said neck.

19. The bottle of claim 18, wherein said at least one pair of wings, said underlying flat ring and said annular connector are monolithic with said pipette.

20. The bottle of claim 15, wherein said closure cap comprises, in an upward region, a plug element, which is directed downward so as to close the dispensing hole of the pipette.

* * * * *